United States Patent [19]

Beanland

[11] 4,367,974

[45] Jan. 11, 1983

[54] SURFACE DRAINAGE SYSTEM AND COVER MEMBER FOR USE THEREIN

[75] Inventor: Neill S. Beanland, Garforth, England

[73] Assignee: West Yorkshire Metropolitan County Council, Wakefield, England

[21] Appl. No.: 230,364

[22] Filed: Jan. 30, 1981

[51] Int. Cl.[3] ..... E01C 11/22

[52] U.S. Cl. ..... 404/5; 52/19

[58] Field of Search ..... 404/5, 4, 2; 210/163; 52/19, 20

[56] References Cited

U.S. PATENT DOCUMENTS

| | | | |
|---|---|---|---|
| 2,436,593 | 2/1948 | Moselowitz | 404/4 |
| 3,250,189 | 3/1965 | Peletz | 404/5 |

FOREIGN PATENT DOCUMENTS

| | | | |
|---|---|---|---|
| 870832 | 3/1942 | France | 404/4 |
| 291893 | 6/1928 | United Kingdom | 404/4 |

*Primary Examiner*—Nile C. Byers, Jr.

*Attorney, Agent, or Firm*—Norbert P. Holler; Charles A. Blank

[57] ABSTRACT

A surface drainage system comprising base members (27) and cover members (32). The base members have a channel formed between opposite walls thereof, and are designed to be laid end-to-end with the channels in longitudinal alignment. The cover members are of inverted channel section and have opposite side walls with a channel defined therebetween. The cover members are laid above the base members and combine therewith to form an enclosed drainage channel. Each cover member has at least one opening (37) extending through a side wall thereof and communicating with the channel. The lowermost part of the opening intersects the outer surface of the respective wall at a location (36) that is no closer to the bottom than to the top of the cover member. A carriageway (35) can be laid with its surface no lower than the point (36), so that drainage is effected through the opening (37) while the base members (27) lie at a significant depth below the carriageway surface.

13 Claims, 20 Drawing Figures

SURFACE DRAINAGE SYSTEM AND COVER MEMBER FOR USE THEREIN

The invention relates to a surface drainage system and to a cover member for use therein. The invention is particularly concerned with a combined kerb and drainage block arrangement for use on highways, although the system does find more general application.

It is accepted that road kerb systems must fulfil a number of basic requirements which may be listed as follows:

a. a clear definition of the carriageway edge must be provided
b. the carriageway edge must be strong enough to prevent deformation by road construction and by heavy vehicles throughout the design life of the road
c. surface water from the carriageway must be controlled and drained therefrom
d. the kerb should assist in preventing traffic leaving the carriageway in hazardous regions thereof
e. the kerb must form a barrier to stop vegetation from spreading onto the carriageway
f. the system must be sufficiently versatile to allow road resurfacing and kerb removal or lowering when new accesses are required
g. the kerb should act as a datum for laying pavement courses
h. the system must be capable of use in conjunction with and as a continuation of conventional kerb systems.

Although there have been many proposals for combined kerb and drainage systems none of these has met all the criteria listed above in a completely satisfactory manner. The objective of the present invention is to provide a system which will more closely meet these requirements.

According to a first feature of the invention we provide a cover member for use in a surface drainage system, the cover member being of inverted channel section and having a top wall and two opposite side walls between which an open-ended channel is defined, and the cover member having at least one opening extending through a side wall thereof and communicating with the channel, the lowermost part of the opening intersecting the outer surface of the respective wall at a location that is no closer to the bottom than to the top of the cover member, and that is desirably from 0.5 to 0.7 of the total height of the cover member.

According to a second feature of the invention a surface drainage system, which may be used as a combined kerb and drainage system for a highway, comprises in combination open-ended channel section base members each having a base wall and two opposite side walls between which the channel is defined, the base members being designed to be laid end-to-end in longitudinal alignment, and cover members as aforesaid laid above the base members and combining therewith to form an enclosed drainage channel.

When used as a kerb and highway drainage system the edge of the carriageway surface must terminate at a level not lower than the lowermost parts of the openings into the side walls of the cover members in order that surface water may drain from the carriageway into the drainage system. Ensuring that these openings are no closer to the bottom than to the top of the cover member and that the cover member is of inverted channel section leads to a number of significant advantages. The positioning of the openings allows there to be a significant depth of cover member between the opening and the base member, and thus a significant depth of carriageway material above the level of the upper edges of the side walls of the base members. This allows versatility in that if drainage is required to run across the carriageway or across a road junction into the carriageway all that needs to be done is for cover members to be omitted in these areas and for the base members to be covered by cover plates over which carriageway material is laid. A significant thickness of material can be applied so that the road surface is not prone to breaking up in the region of the crossing. The depth of the cover members below the opening can be made such that the total depth of cover member is similar to or greater than the total depth of conventional kerbs so that the system can be laid as a simple continuation of conventional kerbing. The inverted channel section of the cover members provides them with significant strength for withstanding traffic loadings while also reducing the amount of material incorporated in the cover members, and thus reducing the weight thereof. The base members may be constructed in incremental depths to cater for accumulated drainage flow and generally speaking it is desirable for the cross-sectional area of the channel in any base member to be such as to accept the full design flow volume through the drainage channel formed by that base member and its associated cover member. The additional area within the cover member is then available for overload drainage conditions and is particularly effective in reducing the effects of turbulence when storm water enters the drainage system.

As well as straight base members and cover members as aforesaid a drainage sytem according to the invention will often include curved base members and junction base members and such base members will usually be covered not by cover members as aforesaid but by inspection or access covers, which may be of conventional form, so that blockages which may occur at bends and junctions can readily be cleared. The system will also usually include base members having an opening in the bottom wall thereof which may be connected to a gulley and/or outfall pipe.

The system will be better understood from the following description given in conjunction with the accompanying drawings, in which.

Figure 1:
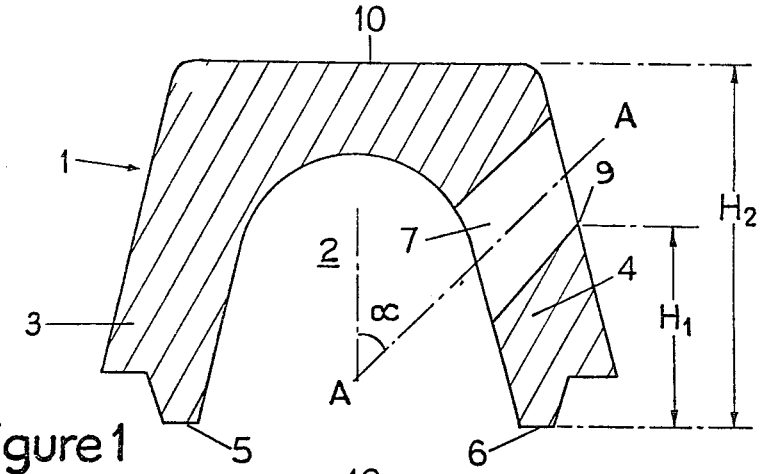
FIGS. 1 to 3 are, respectively, a cross-section, side elevation and plan view of a cover member.
Figure 2:
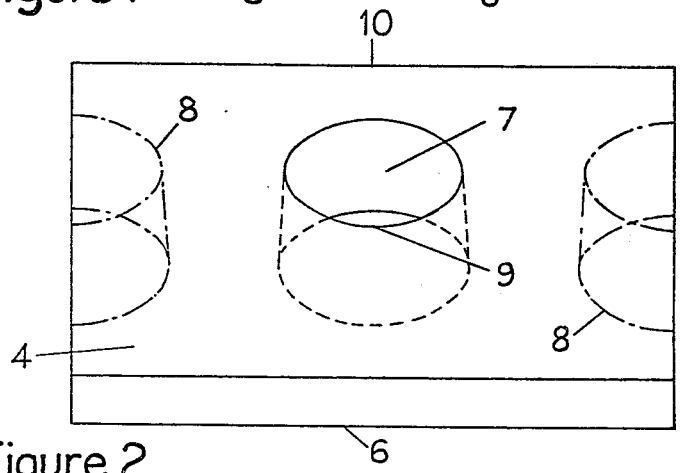
Figure 3:
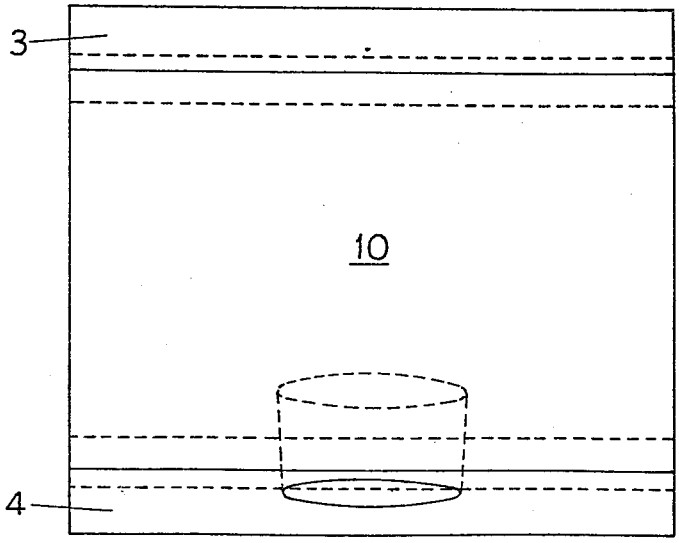

The basic system comprises in combination open-ended channel section base members together with cover members of inverted channel section. A typical cover member is shown in FIGS. 1 to 3 and is made to a standard size designed to withstand traffic loadings and shaped to match any required kerb face. The cover member, shown generally as 1, is of inverted channel section with the channel 2 being formed between symmetrical opposite side walls 3 and 4, the lower edges 5 and 6 of which are of interlocking formation designed to engage the base members. An opening 7 is provided at the longitudinal central region of the cover member and extends through the side wall 4 of the cover member. The lowermost part 9 of the opening where it intersects the side wall is located no closer to the bottom than to the top of the respective cover member. In preferred constructions the height $H_1$ of the lowermost part 9 above the bottom of the cover member is from 0.5 to 0.7 of the total height $H_2$ of the cover member. The edge formed at the part 9 may be rounded off if desired. The transverse cross-sectional shape of the opening is desirably somewhat oval as shown in FIG. 2, although other shapes, e.g. rectangular may be used. An oval shape facilitates manufacture, reduces the degree of weakening of the surrounding material, reduces the length of unsupported carriageway lying across the lower part of the opening and provides an upwardly increasing width that facilitates rapid access into the system of deeper water experienced, for example, during storm conditions. The transverse cross-sectional area of the opening desirably increases from the outer to the inner surface of the side wall, for example by a progressive flare as shown in FIGS. 1 and 2. This assists in allowing free passage of solid material into the channel and so reduces the risk of blockage. However, openings of constant transverse cross-sectional area could be used.

In another embodiment openings such as shown by phantom lines 8 in FIG. 2 may be made one at each end of the member, or a single opening may be located at one end of the member. For certain applications the member may be modified by having an opening or openings in each of the opposite side walls 3 and 4. The axis of any opening through the side wall, e.g. axis A—A in FIG. 1, should, in preferred embodiments make an angle $\alpha$ to the plane extending along the channel midway between the side walls (which plane will be vertical in normal use) of from 40° to 50°. Angles at the mid to the lower end of this range are preferable as the top wall of the member then has greater strength and inspection of the channel is facilitated, as is entry of storm water into the system. A 45° angle has been found to be particularly suitable.

Figure 4:
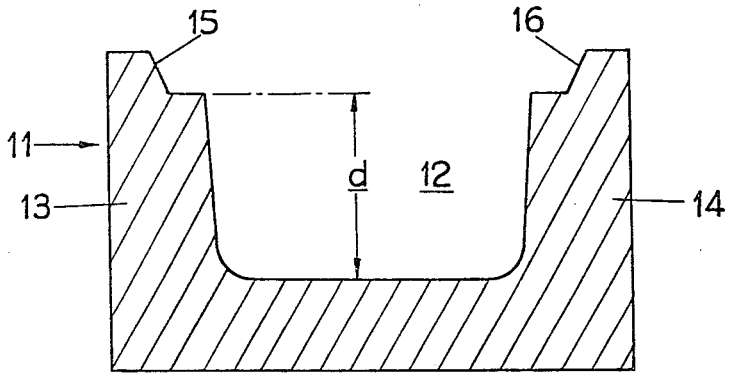
FIGS. 4 to 6 are, respectively, a cross-section, side elevation and plan view of a base member.
Figure 5:
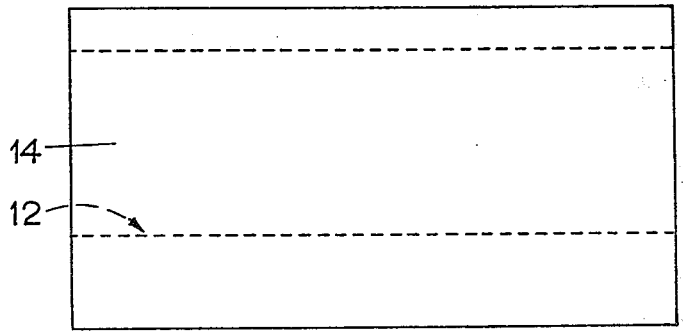
Figure 6:
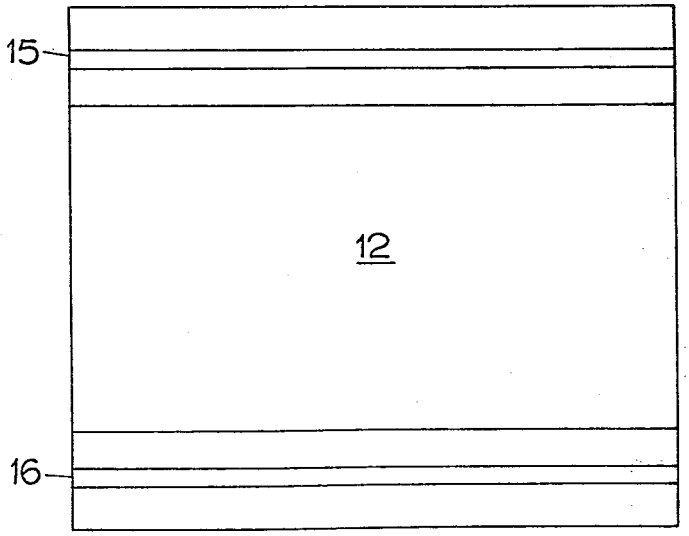

A typical base member 11 is shown in FIGS. 4 to 6. A range of similar base members may be provided, all being generally similar in cross-section but having channels 12 of different depths d. In each case the channel 12 will be formed between symmetrical opposite side walls 13 and 14 having upper edges 15 and 16 respectively shaped to match the lower edges 5 and 6 of the side walls of the cover member and so locate the cover member on the base member.

The profile of the channel 12 in the base member may be shaped to suit the anticipated flow velocities of water through the channel. Certain base members may be designed with the base of this channel sloping to form a transition member between base members having channels of different depths d.

Both the cover members and the base members may be made from concrete or other suitable material and are designed to withstand the loadings imposed during highway construction and also the traffic loadings on the finished highway.

In addition to the cover members and base members described a drainage system according to the invention will generally include other members as hereinafter described.

Figure 7:
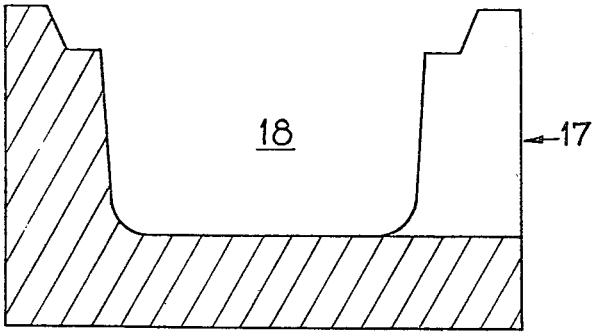
FIGS. 7 to 9 are, respectively, a cross-section, side elevation and plan view of a base junction member.
Figure 8:
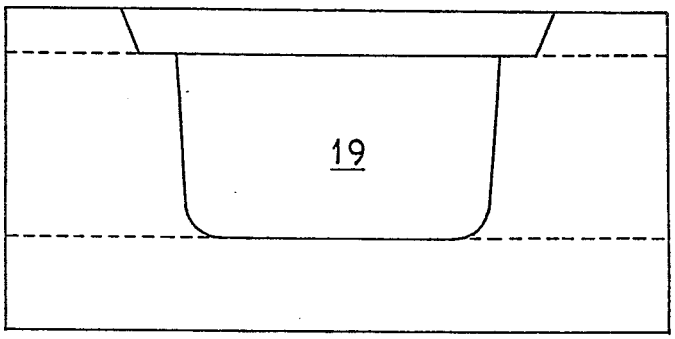
Figure 9:
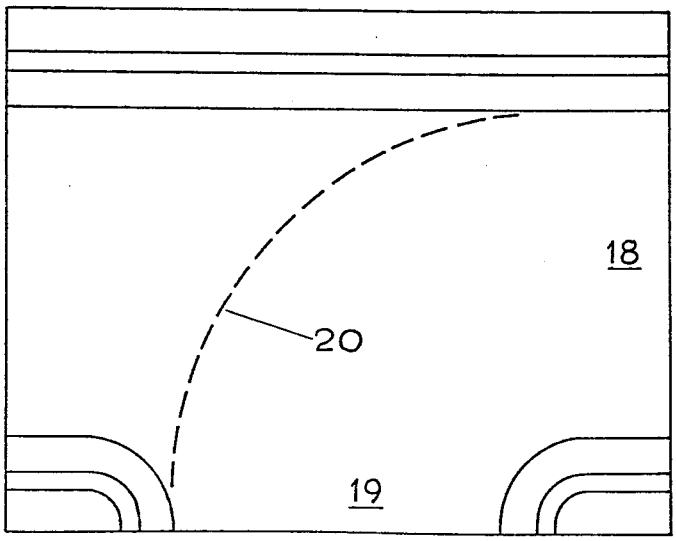

FIGS. 7 to 9 show a typical base junction member which enables flows to be joined and/or diverted. The base junction member shown generally as 17 comprises a main channel 18 and in the direction perpendicular to this main channel the cross-section is generally similar to that of the base member as shown in FIG. 4. The base junction member also includes a branch channel 19 which has a cross-section similar to that of the channel 18 and opening into that channel. A base member of this type can be modified to give flow diversion rather than a junction arrangement by filling in one end of the member with material such as concrete, terminating along a curved line such as 20.

Figure 10:
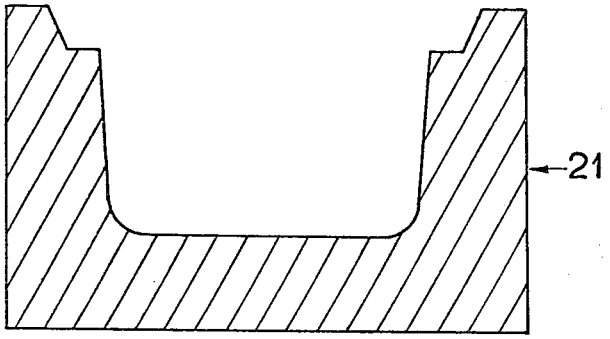
FIGS. 10 to 12 are, respectively, a cross-section, side elevation on line A—A and plan view of a curved base member.
Figure 11:
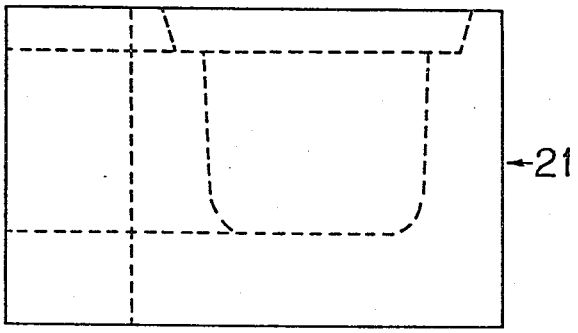
Figure 12:
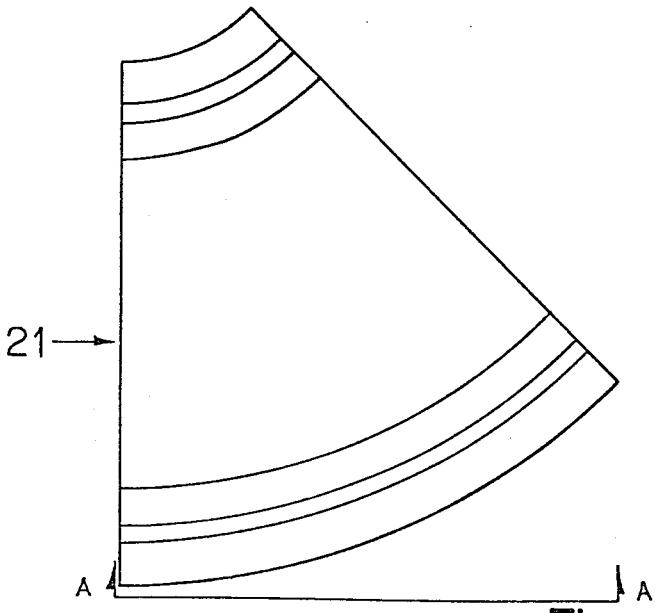

FIGS. 10 to 12 show a curved base member 21 which may be incorporated in the system and which will be effective to divert the flow through an angle of 45°. Obviously curved members may also be made for flow diversion through other angles as required.

Any one of the base members shown in FIGS. 4 to 12 may be formed with a vertical outlet through its base so that it may be located over a sump to collect grit and debris, or located over an outfall pipe to allow water to flow from the system.

Figure 13:
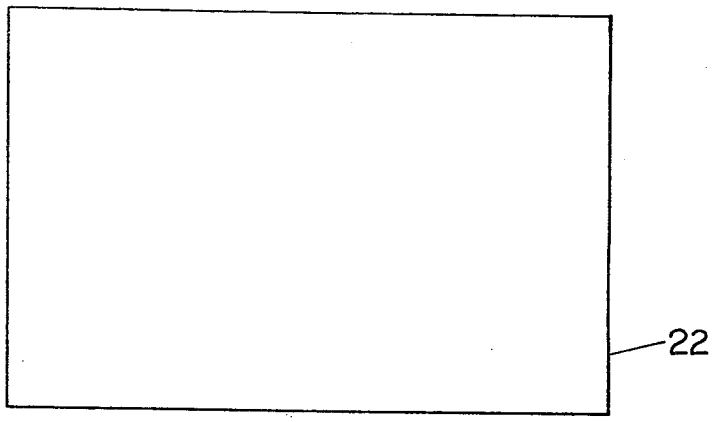
FIGS. 13 and 14 are plan views of cover plates.
Figure 14:
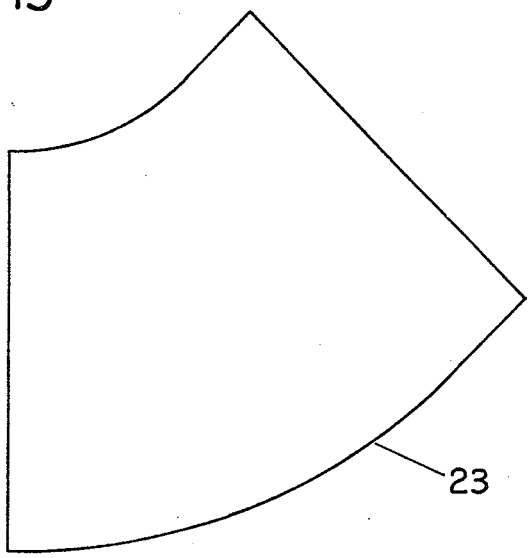
Figure 15:
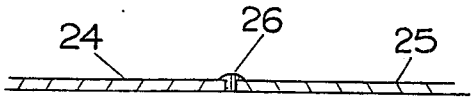
FIG. 15 is a cross-section of a joint between adjacent cover plates.

The base member may be used to carry flows under carriageways, footways, verges, kerbs and other locations and in such cases the open top of the channel in the base member may be closed by a cover plate or cover block. A plan view of a typical cover plate 22 for a base member as shown in FIG. 6 is shown in FIG. 13, and a plan view of a cover plate 23 for the curved base member shown in FIG. 12 is shown in FIG. 14. The spaces between adjacent cover plates 24, 25 are desirably sealed by a jointing strip 26 as shown in FIG. 15. Such cover plates are desirably of metal and are used where a run of base members are to pass under a carriageway or other heavy load bearing location. Where location under a verge or other lightly loaded area is required a cover block of concrete or other material moulded to seat on the upper edges 15 and 16 of the walls of the base member may be used. Alternatively, where a reduced height, but uncovered section of the system is required it is possible to use cover members similar to those shown in FIGS. 1 to 3, but of reduced height and with correspondingly smaller channels. Longitudinally tapered cover members could be used to join normal height members smoothly to those of reduced height.

In addition to the elements of the system so far described the system may include conventional surface water drainage components at certain locations. Thus, standard "side entry" kerb type gulley covers and frames or similar forms of inspection covers may be provided in place of cover members for inspection and maintenance purposes. These may be provided at junctions and outfalls as well as at bends in the system and at intervals on long lengths of the system. Where inspection covers are not provided over bends and junctions then it is desirable to use cover plates as shown in FIG. 13 or 14 rather than the usual cover members. In certain locations the cover plate or cover member may be replaced by a standard drainage grating in order to collect surface water directly into the base member system. This facility of being combined with existing standard items adds increased versatility to the system.

Figure 16:
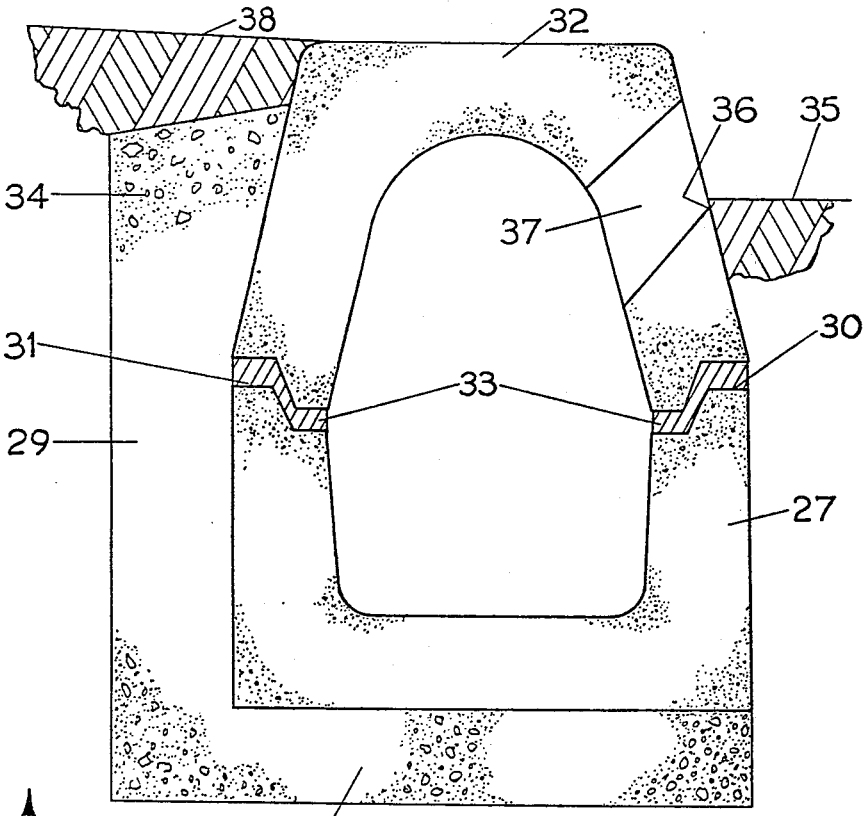
FIG. 16 is a cross-section of a cover member and base member in situ in a drainage system.

FIG. 16 shows a cross-section of a base member and a cover member in situ in a drainage system. A base block 27 preferably made of high quality pressed or vibrated concrete (and including reinforcement if necessary) is laid on a concrete or mortar bed 28 with a concrete backing 29. A number of such base members are laid end-to-end to form a continuous channel. Where the anticipated maximum flow of water increases then base members of increased depth may be used with transition base members inserted between base members of different depths, all base members generally being laid so that the upper surfaces 30 and 31 of the side walls of the base members are substantially coplanar. If greatly increased depth is required, or if cover members need to be significantly raised due to carriageway re-surfacing then vertical spacing members having appropriate interlocking formations on their upper and lower edges may be interposed between the side walls of the cover and base members.

A jointing compound may be used to seal the vertical joints between adjacent base members or those members may be constructed with ends to allow conventional "spigot and socket", "Ogee" or "flexible" type pipe joints. A long run of base members placed end-to-end may be replaced by a continuously extruded concrete block of similar profile in some locations. When laying the run of base blocks during carriageway construction it may be desirable temporarily to omit one base member at intervals in order to collect surface water from the adjacent carriageway construction bed.

Cover members 32 are then bedded onto the respective base members or spacing members using mortar or jointing compound 33 to the required alignment. The cover members may be provided with partial concrete backing 34 where anticipated traffic loadings indicate this to be desirable. Again, during carriageway construction occasional cover members may be temporarily omitted to facilitate drainage from the construction works. The base members and cover members should be fixed and bedded in position before carriageway construction materials are laid adjacent to them in order to cater for construction traffice loading. After construction the carriageway surface 35 is laid with the level of the carriageway edge being at or desirably slightly above the lowermost part 36 of the openings 37 into the cover members. A footway or verge 38 may then be laid to abut the opposite side of the cover member 32.

It will be seen from FIG. 16 that small depths of road resurfacing may be laid without serious detriment to the efficiency of the drainage system. In extreme cases the cover members may be removed, the height built up with spacing members in the form of insert blocks or with in situ concrete or mortar on the upper edges of the walls of the base members and the lower members replaced to accommodate full road resurfacing without affecting the base member invert levels. Also, where it is necessary to have adjacent footway surfaces below the top of the cover member, those cover members may be constructed with additional inlets in the back wall to accept surface water directly from the footways. Alternatively occasional ones of a run of standard cover members may be turned through 180° so that the inlet may face the footway rather than the carriageway.

Figure 17:
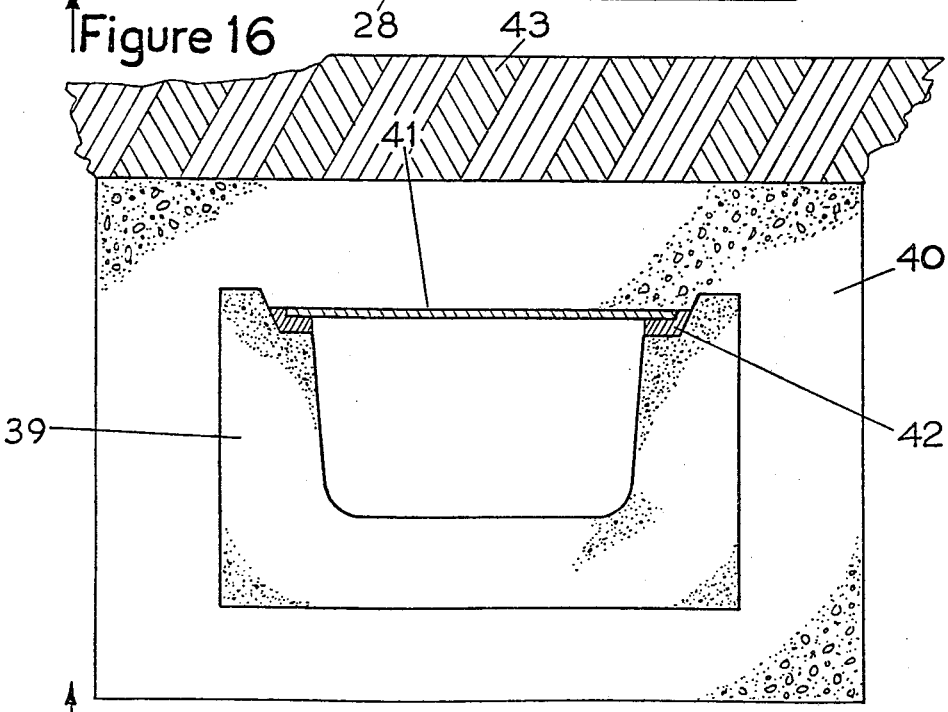
FIG. 17 is a cross-section of a cover plate and base member in situ in a drainage system.

When flows of water are to be diverted underneath carriageways or other elements the cover members are omitted and the cross-section may then be as shown in FIG. 17. As shown in this Figure, base members 39 are bedded into and surrounded with concrete 40 and the open top of the channel in the base member is covered by a plate 41 bedded onto mortar or a jointing compound 42. The plates may be of galvanised steel or other similar material of thickness to suit the respective anticipated traffic loadings. Sealing strips such as shown in FIG. 15 may be fixed to the joints between adjacent plates before the plates are covered with concrete and/or with road construction materials 43.

Figure 18:
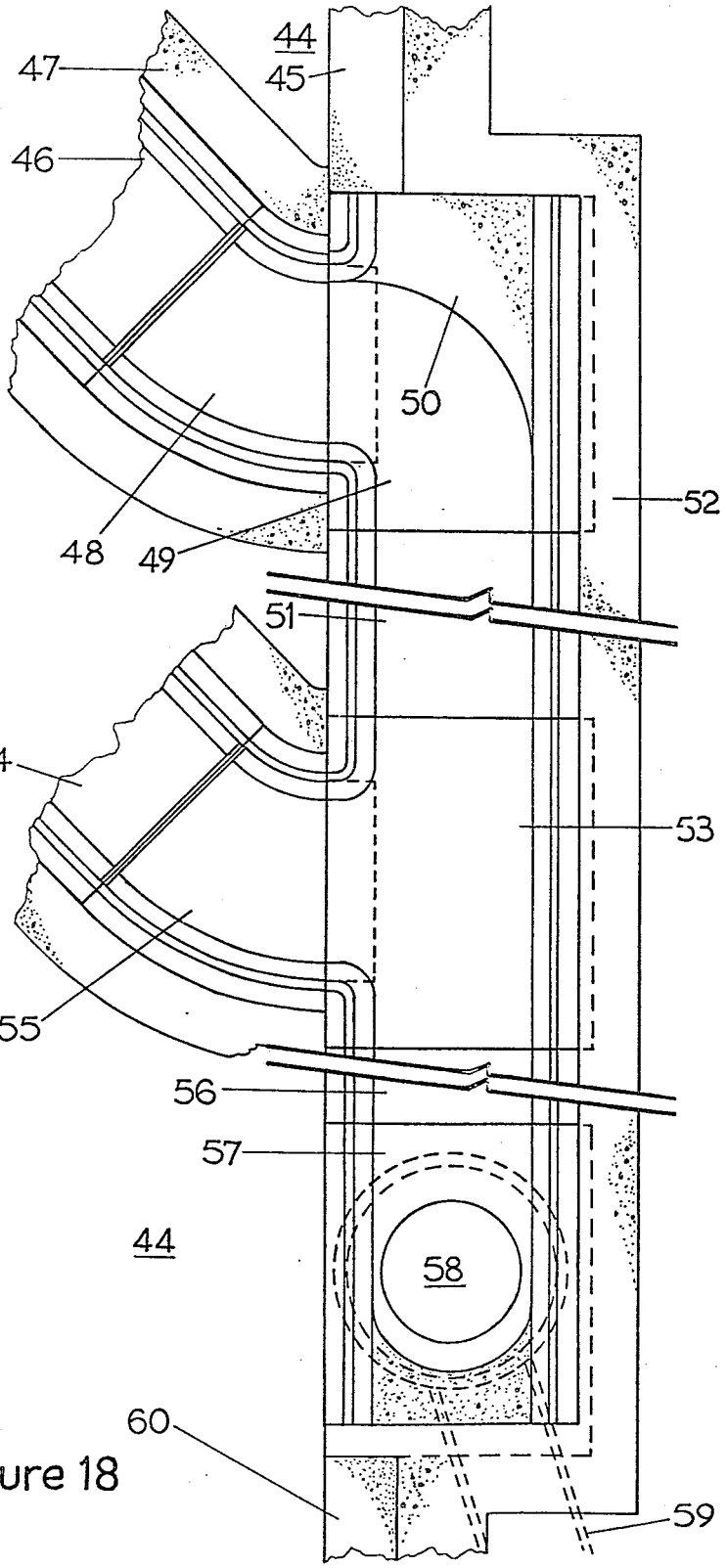
FIG. 18 shows a schematic plan view of part of a drainage system layout.

FIG. 18 shows part of a drainage system layout along one edge of a carriageway 44. Reading from the top of the Figure a conventional kerb 45 extends alongside the carriageway and is backed by concrete in the normal manner. Part of a drainage system according to the invention crosses the carriageway by means of a run of base members such as 46 set in a concrete surround 47, each base member being provided with a cover plate as shown in FIG. 17. At the end of this cross run a curved base member 48 is incorporated and joins the member 46 to a junction base member 49, one end of which is filled with in situ concrete 50 to form a bend. Adjacent to the junction base member 49 there extends a run of base members 51, both the junction member 40 and the base members 51 being set in a concrete foundation and backing 52 in the manner shown in FIG. 16. Alternatively, the junction member 49 could be omitted and the run 46 joined to the run 51 by a curved member such as 48 of appropriate orientation. The curved base member 48 is covered by a curved cover plate as shown in FIG. 14 while the junction base member 49 is covered by a kerb type gulley cover. The base members 51 are fitted with cover members as shown in FIG. 16. At the end of the run of base members 51 is a further junction base member 53 receiving the flow from a further set of base members 54 crossing beneath the carriageway and terminating in a curved base member 55. Again the base members 54 are covered by cover plates, the curved base member 55 has a curved cover plate as shown in FIG. 14 and the junction member 53 is covered by a kerb type gulley cover. A further run of base members 56 and cover members as shown in FIG. 16 then extends to a final base member 57 in the bottom of which is formed an aperture 58 connected to a sump and outfall pipe 59. The base member 57 is again covered by a kerb type gulley cover and from it can extend conventional kerbing 60 aligned to continue the carriageway kerbing.

It will be understood that FIG. 18 is merely exemplary, but it does illustrate the manner in which drainage systems according to the invention may be designed to suit any location.

Figure 19:
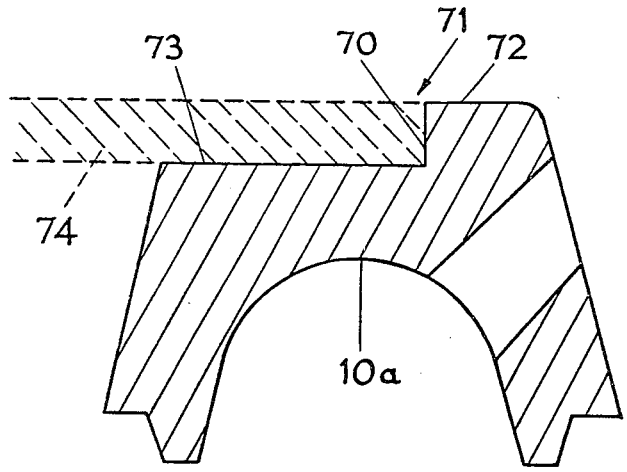
FIGS. 19 and 20 are cross-sections similar to FIG. 1 of alternative forms of cover members.
Figure 20:
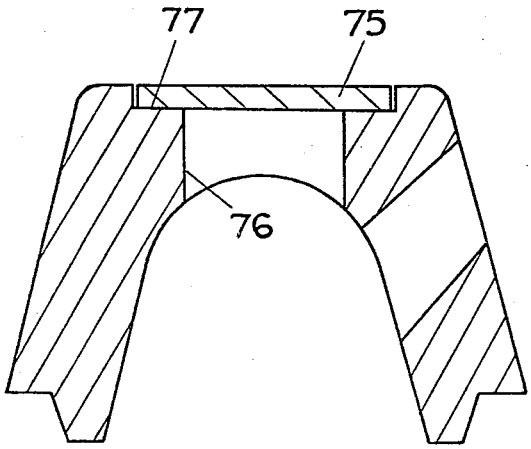

Two variants of cover member are shown in FIGS. 19 and 20. In the first of these a longitudinally extending step 70 is formed along the outer surface 71 of the top wall 10*a*, so that one longitudinal part 72 of that surface is at a higher level than the other longitudinal part 73 thereof. The width of the part 72 is desirably equal to the width of conventional kerbing and the members are laid so that parts 72 extend a run of such kerbing. Paving flags 74 or other footway material may be laid on the part 73, the height of the step 70 being such that the upper surface of the footway is level with the part 72. FIG. 20 illustrates how a cover member may be modified to incorporate an inspection cover 75. The central part of the member is formed with an opening 76 through the top wall thereof, a recessed flange 77 being left around the opening. This flange supports the cover 75 and any appropriate form of interlocking or sealing arrangement may be incorporated between the flange and the cover.

The drainage system of the invention varies from other specialised combined kerb and drainage systems in that the profiles of the base members and cover members have been designed to cater for conveying the maximum quantity of surface water flow in addition to catering for loadings imposed by heavy traffic, with resulting economy in the size and weight of the members. It is particularly preferred that the cross-sectional area of the channel in the base member at any one location is designed to carry the maximum anticipated flow, so leaving the whole of the channel area within the cover members available to cope with exceptional overloads or with turbulent inflow during storm water conditions.

Usually the longitudinal fall of the channel formed by the system will be similar to that of the carriageway along which it is installed, although in particular circumstances slightly differing falls may be constructed.

The drainage system is capable of being used as extensions to existing kerbs, of crossing under carriageways, footways, verges, vehicle crossings and other obstructions, and of allowing for junctions and changes in direction of flow. Furthermore, it is designed with sufficient surface water inlet area so as not to become blocked by grit or debris. In addition to these advantages it can easily be maintained can be used in conjunction with many conventional drainage fittings, and can readily be added to conventional kerb and drainage systems.

I claim:

1. A concrete cover member for use in a surface drainage system, the cover member being of inverted channel section and, as seen in cross-section, having a top wall and two opposite, symmetrical side walls which diverge from the top to the bottom of the cover member, the inner surface of the top wall and the diverging inner surfaces of the side walls defining respectively the top and sides of the channel, the channel having an open bottom and ends and being of uniform cross-section throughout the length of the cover member, and the cover member having at least one opening extending at a downward inclination through a side wall thereof from the outer surface to the inner surface of the side wall, the transverse cross-sectional area of the opening increasing from the outer surface to the inner surface of the side wall, the intersection of the opening with the outer surface of the side wall having a lowermost part that is no closer to the bottom than to the top of the cover member and the whole of the opening intersecting the inner surface of the side wall to open into the respective side of the channel.

2. A cover member according to claim 1 in which said lowermost part of the intersection of the opening with the outer surface of the side wall is located at from 0.5 to 0.7 of the total height of said cover member.

3. A cover member according to claim 1 in which the axis of the opening makes an angle to the plane extending along the channel midway between the side walls of from 40° to 50°.

4. A cover member according to claim 1 in which the transverse cross-section of the opening is oval in shape.

5. A cover member according to claim 1 in which there is a single opening located at the longitudinal central region of the cover member.

6. A cover member according to claim 1 in which the lower edge of each side wall is formed with a longitudinally extending interlock formation designed to interlock with a member on which the cover member is superimposed.

7. A cover member according to claim 1 and incorporating an inspection cover in the top wall thereof.

8. A surface drainage system comprising in combination open-ended channel section concrete base members each having a base wall and two opposite side walls between which the channel is defined, the base members being designed to be laid end-to-end in longitudinal alignment, and concrete cover members each being of inverted channel section and, as seen in cross-section, having a top wall and two opposite, symmetrical side walls which diverge from the top to the bottom of the cover member, the inner surface of the top wall and the diverging inner surfaces of the side walls defining respectively the top and sides of the channel, the channel having an open bottom and ends and being of uniform cross-section throughout the length of the cover member, and the cover member having at least one opening extending at a downward inclination through a side wall thereof from the outer surface to the inner surface of the side wall, the transverse cross-sectional area of the opening increasing from the outer surface to the inner surface of the side wall, the intersection of the opening with the outer surface of the side wall having a lowermost part that is no closer to the bottom than to the top of the cover member and the whole of the opening intersecting the inner surface of the side wall to open into the respective side of the channel, the cover members being laid above the base members and combining therewith to form an enclosed drainage channel.

9. A surface drainage system according to claim 8 in which said lowermost part of the intersection of the opening with the outer surface of the side wall is located at 0.5 to 0.7 of the total height of said cover member.

10. A surface drainage system according to claim 8 in which the axis of the opening makes an angle to the plane extending along the channel midway between the side walls of from 40° to 50°.

11. A surface drainage system according to claim 8 in which the transverse cross-section of the opening is oval in shape.

12. A surface drainage system according to claim 8 in which there is a single opening located at the longitudinal central region of each cover member.

13. A surface drainage system according to claim 8 in which lower edges of the side walls of the cover members are received on and interlock with upper edges of the side walls of the base members.

* * * * *